US009822505B2

(12) United States Patent
Zhou

(10) Patent No.: US 9,822,505 B2
(45) Date of Patent: Nov. 21, 2017

(54) TIE DOWN ANCHOR ASSEMBLY

(71) Applicant: Wei Zhou, Beijing (CN)

(72) Inventor: Wei Zhou, Beijing (CN)

( * ) Notice: Subject to any disclaimer, the term of this patent is extended or adjusted under 35 U.S.C. 154(b) by 0 days.

(21) Appl. No.: 14/225,088

(22) Filed: Mar. 25, 2014

(65) Prior Publication Data

US 2017/0233972 A1 Aug. 17, 2017

(51) Int. Cl.
*E02D 5/80* (2006.01)

(52) U.S. Cl.
CPC ..... *E02D 5/80* (2013.01)

(58) Field of Classification Search
CPC ..... E02D 5/80
USPC ..... 52/155, 158, 160; 135/118
See application file for complete search history.

(56) References Cited

U.S. PATENT DOCUMENTS 1,808,633 A * 6/1931 Carver ..... E02D 5/80 52/158
1,811,217 A * 6/1931 Spaugh ..... E04H 17/08 52/125.6
3,480,023 A * 11/1969 McConnell ..... E04H 15/62 135/118
3,591,113 A * 7/1971 Foster, Jr. ..... H01Q 1/1242 248/163.1
3,903,662 A * 9/1975 Gabliya ..... E02D 27/42 52/157
4,953,576 A * 9/1990 Connelly ..... E04H 15/322 135/118
5,243,795 A 9/1993 Roberts
5,625,983 A * 5/1997 Lachance ..... E02D 5/74 135/118
5,873,679 A 2/1999 Cusimano
6,735,911 B1 * 5/2004 Alexander ..... E02D 5/80 248/500
8,561,361 B2 * 10/2013 Bauletti ..... E02D 5/74 52/155
9,138,812 B2 * 9/2015 Stalemark ..... B23B 47/28
9,499,998 B2 * 11/2016 Bardelli ..... E02D 5/80
2003/0066251 A1 * 4/2003 Cusimano ..... E02D 27/01 52/169.9
2004/0148877 A1 * 8/2004 Roberts ..... E02D 5/80 52/155
2013/0048043 A1 * 2/2013 Zhou ..... E04H 15/62 135/118

* cited by examiner

*Primary Examiner* — Paola Agudelo
(74) *Attorney, Agent, or Firm* — R. Tracy Crump

(57) ABSTRACT

A tie down anchor assembly that is adapted to receive the stakes through angled bores as they are driven into the ground where at least one stake can be driven into the ground at different angular orientations. The anchor assembly of this invention includes a plurality of stakes and a modular anchor hub. The anchor hub has an interconnected modular design and includes a main hub component, a shaft component, and a tether connector, which can be disassembled for convenient storage and transport. The main hub component has a pair of protrusions and the shaft component is rotatably connected to the main hub component so that the protrusion and the shaft component act as three "anchor legs" extending radially from the body of the main hub component 130—two fixed and one rotatable. Each of the "anchor legs has an angled stake bore for receiving one of the stakes.

15 Claims, 11 Drawing Sheets

TIE DOWN ANCHOR ASSEMBLY

This invention relates to tie down stakes and earth anchors, and in particular a modular anchor using multiple stakes and central hub that allows for selected stake angle.

BACKGROUND AND SUMMARY OF THE INVENTION

Tie down stakes and earth anchors are used in a variety of applications from tethering pets, securing tents and anchoring structures. The present invention seeks to provide an improved tie down anchor assembly that is adapted to receive the stakes through angled bores as they are driving into the ground where at least one stake can be driven into the ground at different angular orientations. The anchor assembly of this invention includes a plurality of stakes and a modular anchor hub. The anchor hub has an interconnected modular design and includes a main hub component, a shaft component, and a tether connector, which can be disassembled for convenient storage and transport. The main hub component has a pair of protrusions and the shaft component is rotatably connected to the main hub component so that the protrusion and the shaft component act as three "anchor legs" extending radially from the body of the main hub component. Each of the "anchor legs has an angled stake bore for receiving one of the stakes. The anchor assembly can be selectively adjusted by the orientation of the shaft component with respect to the main hub component for ground anchoring either a vertical tether force where the pull force is substantially perpendicular to the ground or an angled tether force where the pull force is at an angle to the ground.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
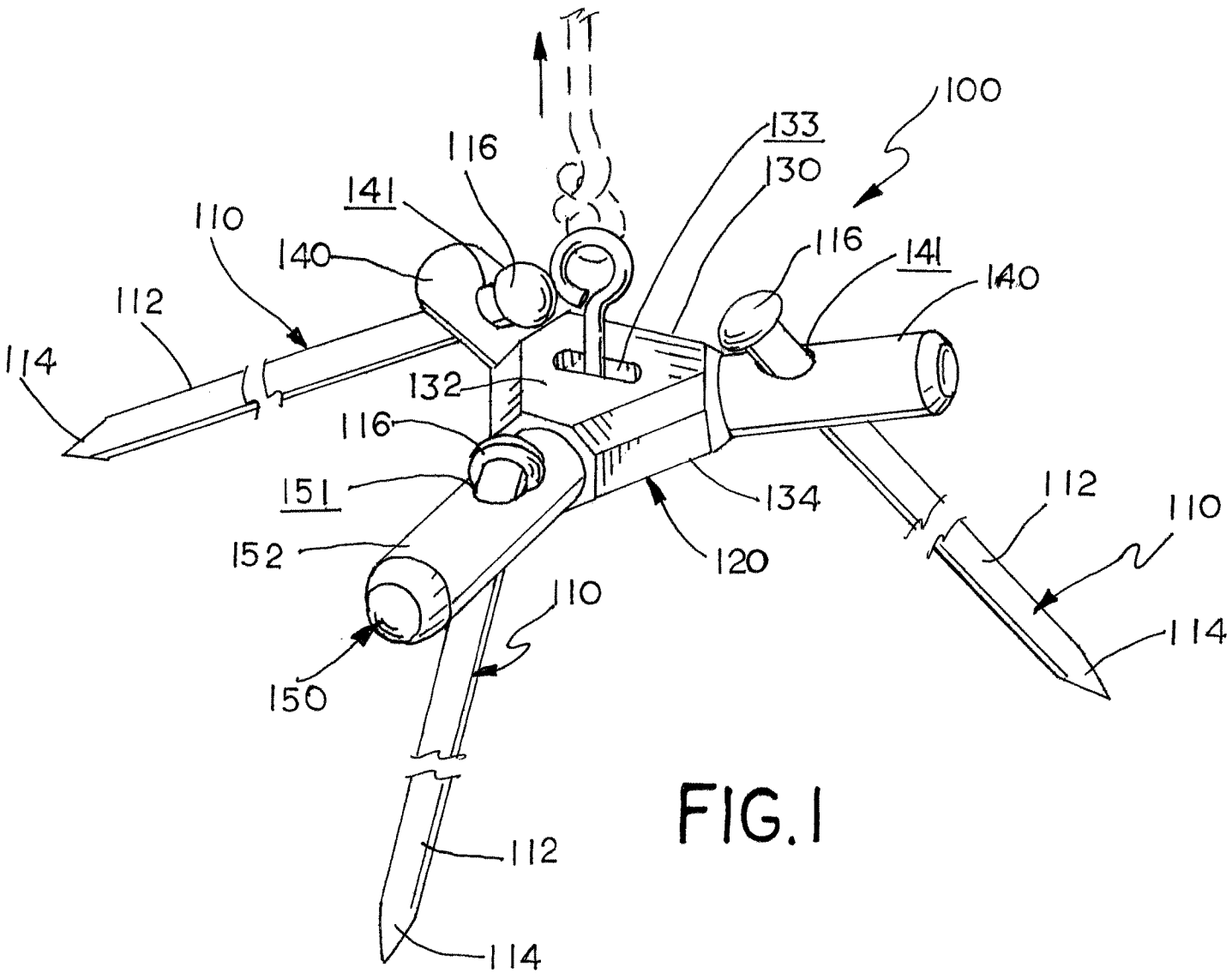
FIG. 1 is a perspective view of an embodiment of the tie down anchor assembly of this invention.
Figure 2:
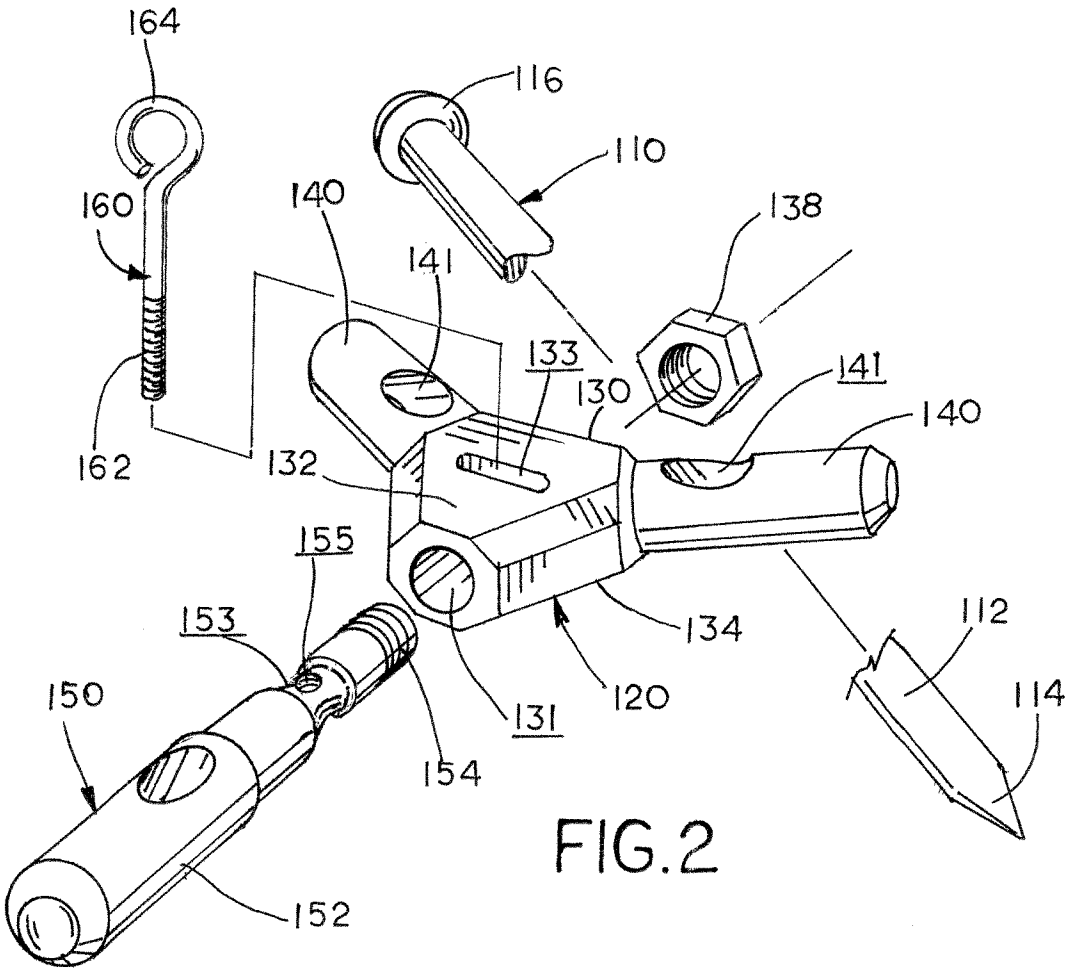
FIG. 2 is an exploded view of the anchor assembly of FIG. 1.
Figure 3:
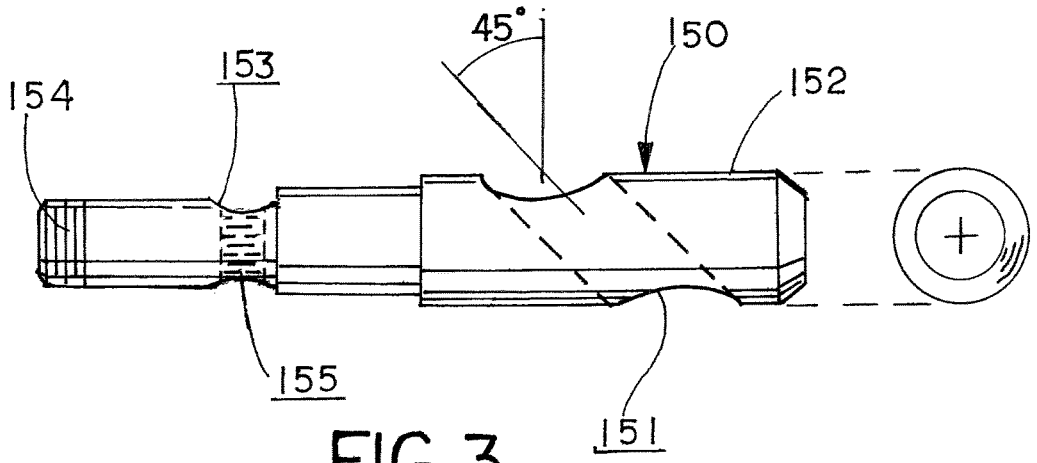
FIG. 3 is a side view of the shaft component of the anchor assembly of FIG. 1 shown in the "vertical pull" orientation.
Figure 4:
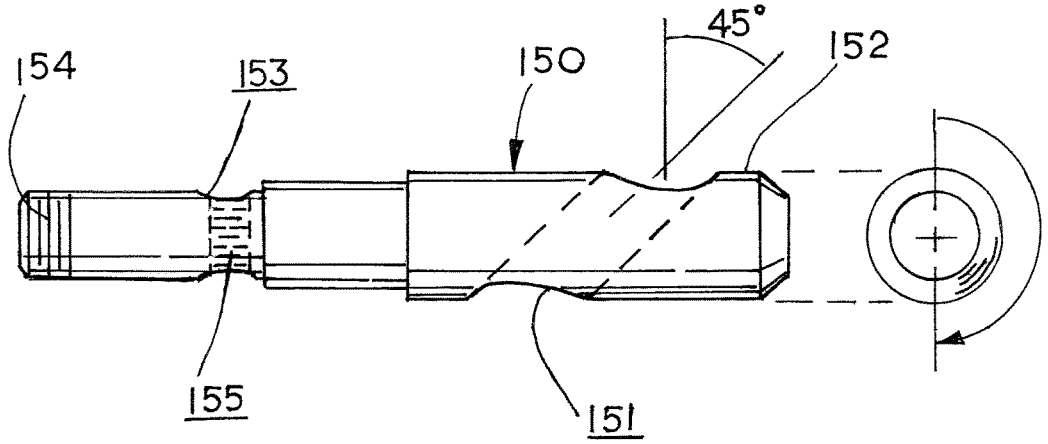
FIG. 4 is a side view of the shaft component of the anchor assembly of FIG. 1 shown in the "angular pull" orientation.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Referring now to the drawings, FIGS. 1-10 illustrate an embodiment of the tie down anchor assembly of this invention, which is designated generally as reference numeral 100. Anchor assembly 100 includes a plurality of stakes 110 and a modular anchor hub 120 adapted to receive the stakes through angled bores as they are driving into the ground where at least one stake can be driven into the ground at different angular orientations. As shown, anchor assembly 100 uses three stakes 110 which are detachably received by anchor hub 120, but alternatively embodiments of this invention may employ any number of additional stakes without departing from the spirit of the invention.

Stakes 110 are constructed from rigid elongated rods fashioned into long spikes a sufficient length to provide secure holding force for the application intended. Each stake has an elongated shaft 112 that terminates in a sharpened tip 114 for penetrating the ground and a blunt head 116 for receiving the blows of a hammer or other object used to drive the stake into the ground. Stakes 110 are generally constructed of a strong, durable metal steel, but may be formed from a polymer material strong enough to withstand being repeatedly driven into hard or rocky soil. As shown, stake shanks 112 generally have a circular cross-section. Stake head 116 has an outer diameter greater than the diameter of stake shank 112. Stake head 116 acts as a stop which prevents the stake from passing completely through the angled bores in anchor hub 120. Stake head 116 facilitates gripping the stake for pulling it up from the ground by hand or using a tool, such as a hammer or ply bar.

Anchor hub 120 has an interconnected modular design and includes a main hub component 130, a shaft component 150, and a tether connector 170, which can be disassembled for convenient storage and transport. Main hub component 130 is formed or machined from a strong lightweight metal, such as aluminum, but may also be molded or formed from a suitable polymer material. Main hub component 130 has a triangular body with a top surface 132 and a ground-contacting bottom surface 134. Main hub component 130 has lateral through bore 131 configured to axially receive shaft component 150 and a slot 133 extending perpendicularly to bore 121 and communicating therewith. Two cylindrical protrusions 140 integrally extend outward from the sides of main hub component 120. Each protrusion 140 has a lateral through bore 141 that extends at a 45 degree angle to the longitudinal axis of the protrusion for receiving one of stakes 110. Bores 141 are formed at a 45 degree angle so that when anchor hub 120 is placed on the ground and stakes 110 are inserted through the bores, the stakes are driven downward and outward into the ground.

Shaft component 150 is an elongated cylindrical shaft rotatably connected to main hub component 130. Shaft 150 has an exposed end 152 that protrudes from main hub component 130 and a threaded end that extends through bore 121 of the main hub component. A hex nut 138 turned onto threaded end 154 secures shaft component 150 to main hub component 120, but allows the shaft component to rotate within bore 121. Shaft component 150 has a lateral through bore 131 formed in its exposed end 152 that extends at a 45 degree angle to the longitudinal axis of shaft component 150 for receiving one of stakes 110. Shaft component 150 also has an annular recess 153 and a threaded lateral bore 155. As shown, exposed shaft end 152 of shaft component 150 and protrusions 140 of main hub component 130 are geometrically identical and extend radially from the body of main hub component 130 at 120 degree angle from one another. Shaft end 152 and protrusions 140 act as "anchor legs" extending radially from the body of main hub component 130—two fixed and one rotatable.

Tether connector 160 is connected to anchor hub 120 and couples anchor assembly 100 to a tether or guide line 10. As shown, tether connector 160 is a closed eye bolt to which a guide or anchor line is tethered. Tether connector 160 has a threaded end 162 that is configured to extend into slot 135 and turned into threaded bore 155 of shaft component 150.

In use, anchor assembly 100 is deployed by placing anchor hub 120 on the ground and driving stakes 110 into the ground though bores 141 and 151 in protrusions 140 and shaft component 150 respectively. A tether line 10 is then tied to tether connector 140 and tightened to tie down the particular structure or apparatus.

Figures 8, 9:
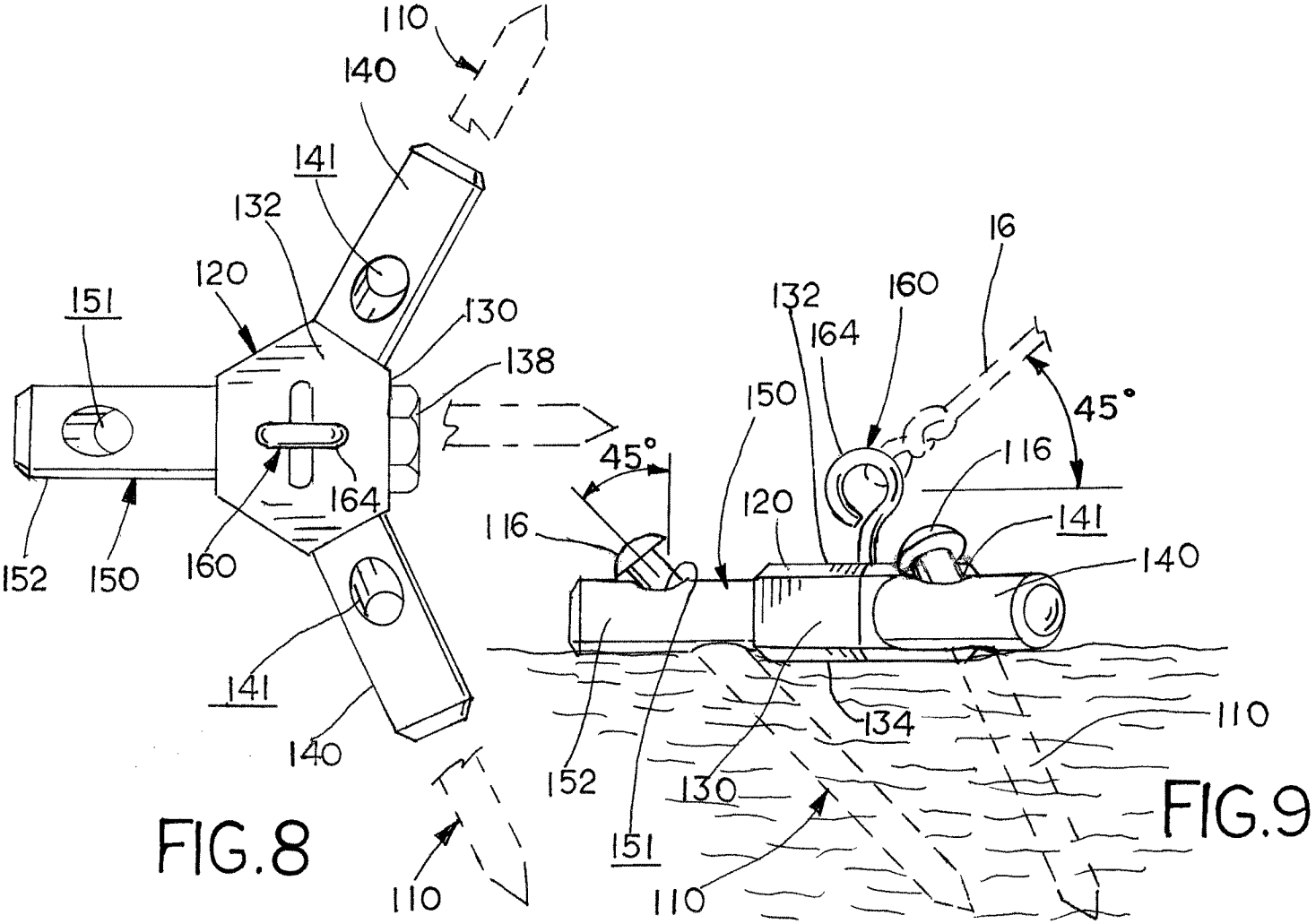
FIG. 8 is a top and partial sectional view of the anchor assembly of FIG. 1 shown in the "angular pull" orientation.
FIG. 9 is a partial end view of the anchor assembly of FIG. 1 shown in the "angular pull" orientation.
Figure 10:
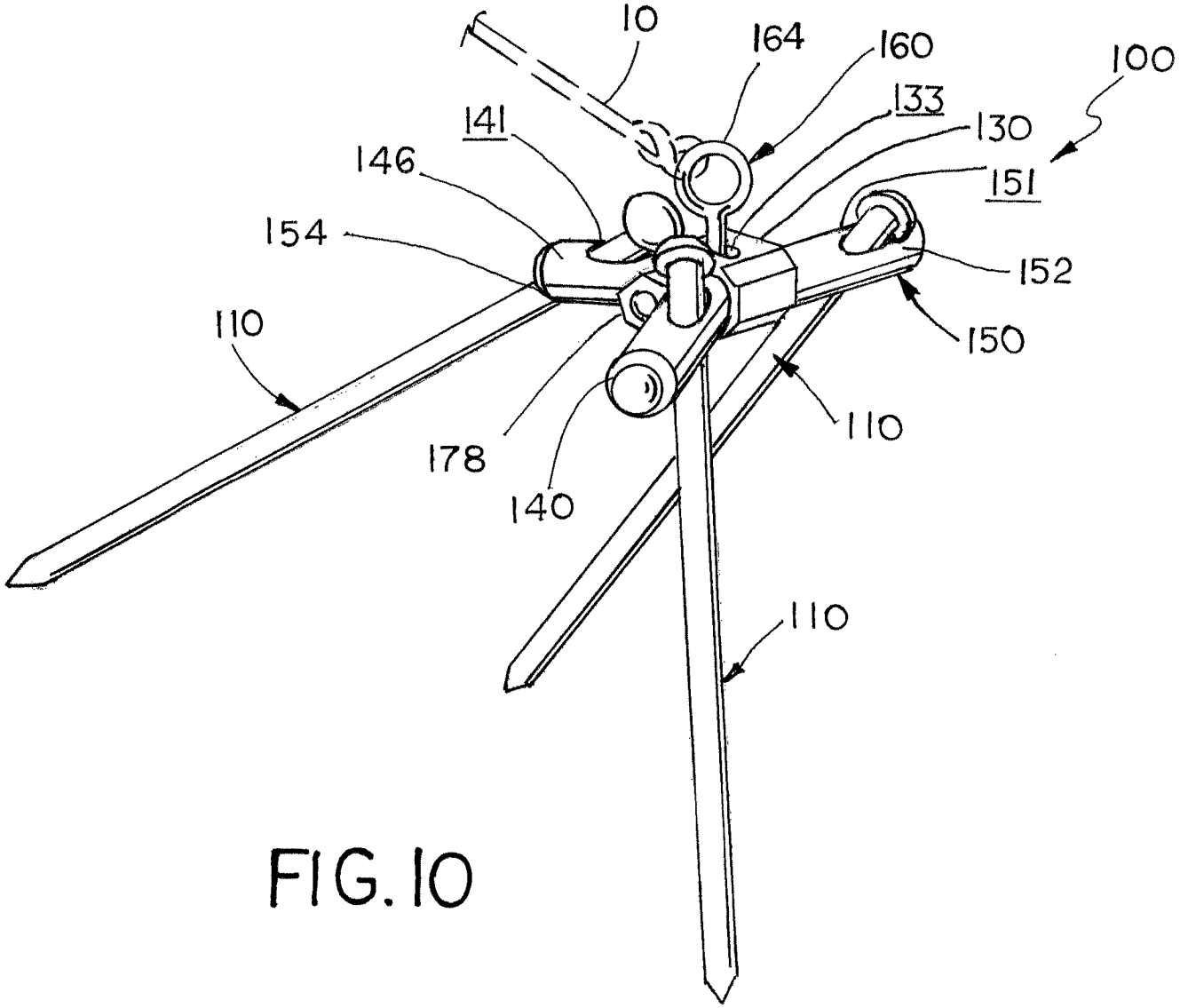
FIG. 10 is another perspective view of the shaft component of the anchor assembly of FIG. 1 shown in the "angular pull" orientation.

Anchor assembly 100 can be selectively adjusted by the orientation of shaft component 150 within main hub component 130 for ground anchoring either a vertical tether force where the pull force is substantially perpendicular to the ground (FIGS. 5-7) or an angled tether force where the pull force is at an angle to the ground (FIGS. 8-10). As shown in FIGS. 3-5 and 8, shaft component 150 can be rotated within bore 131 and secured by tether connector 160 in one of two orientations: a "vertical pull" orientation or an "angular pull" orientation. In the "vertical pull" orientation, shaft component 150 is rotated so that the bore 151 is oriented to mirror bores 141 of protrusions 140 where all of the stake bores extend at a 45 degree angle downward and away from the top of main hub component 120. In the "vertical pull" orientation, stakes 110 are driven downward through the stake bores 141 and 151 into the ground and each stake extends radially downward and outward from the anchor hub 120. In the "angular pull" orientation, shaft component 150 is rotated 180 degrees so that the bore 151 is oriented opposite of bores 141 of protrusions 140. In the "angular pull" orientation, bore 151 extends at a 45 degree angle downward and inward from the top of main hub component 120. Consequently, the stake 110 driven through bore 151 is driven downward and inward under the anchor hub 120 so that all three stakes 110 are angled against the direction of the force pulling on anchor 100. Turning threaded end 172 of tether connector 170 through slot 133 into threaded bore 155 locks shank component 150 in either the "vertical pull" or "angular pull" position and prevents the shank component from rotating within main hub component 130. Changing the bore orientation is accomplished simply by disconnecting tether connector 160 from shaft component 150, rotating the shaft component 180 degrees and reconnecting the tether connector.

Figure 5:
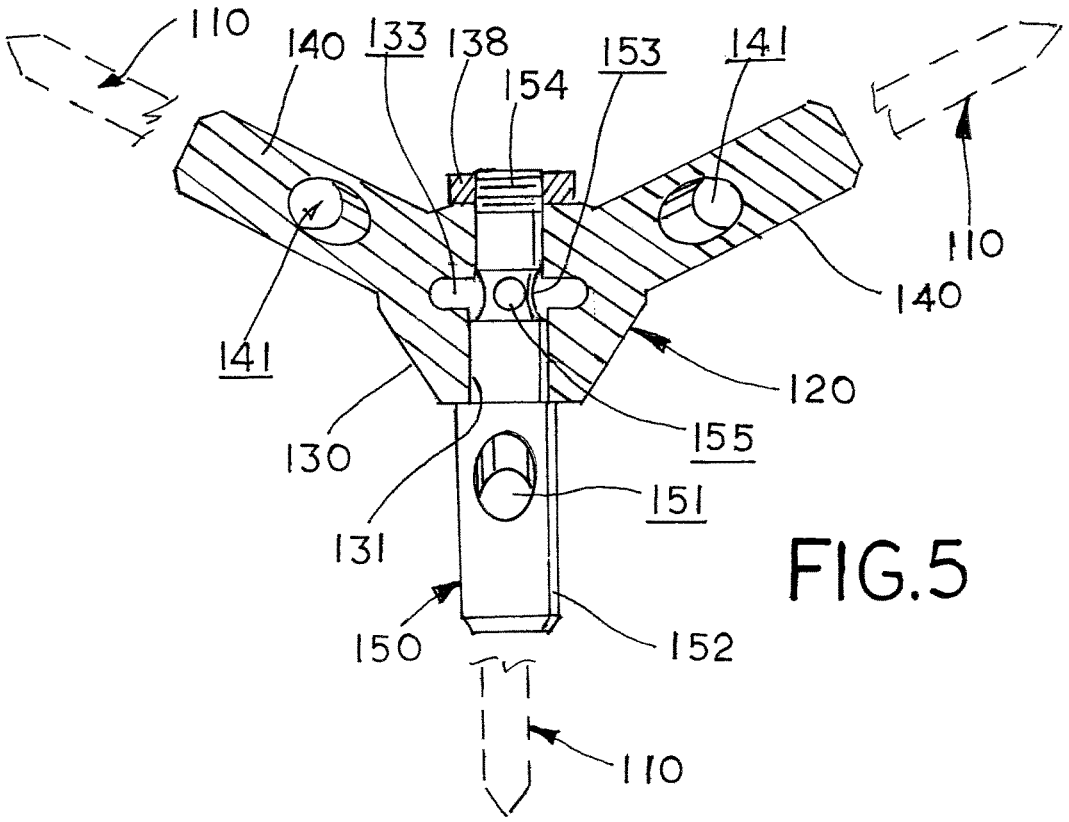
FIG. 5 is a top and partial sectional view of the anchor assembly of FIG. 1 shown in the "vertical pull" orientation.
Figure 6:
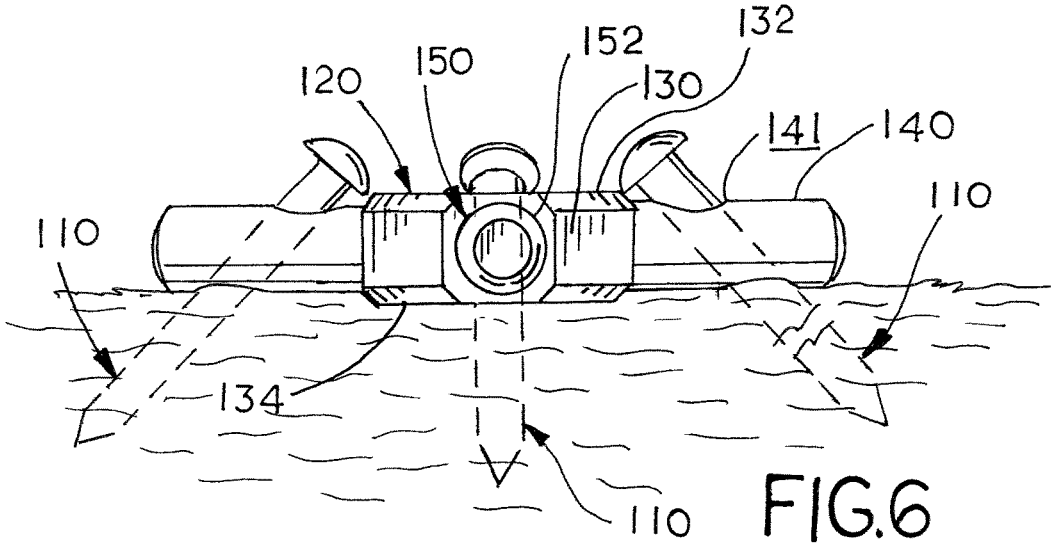
FIG. 6 is a partial end view of the anchor assembly of FIG. 1 shown in the "vertical pull" orientation.
Figure 7:
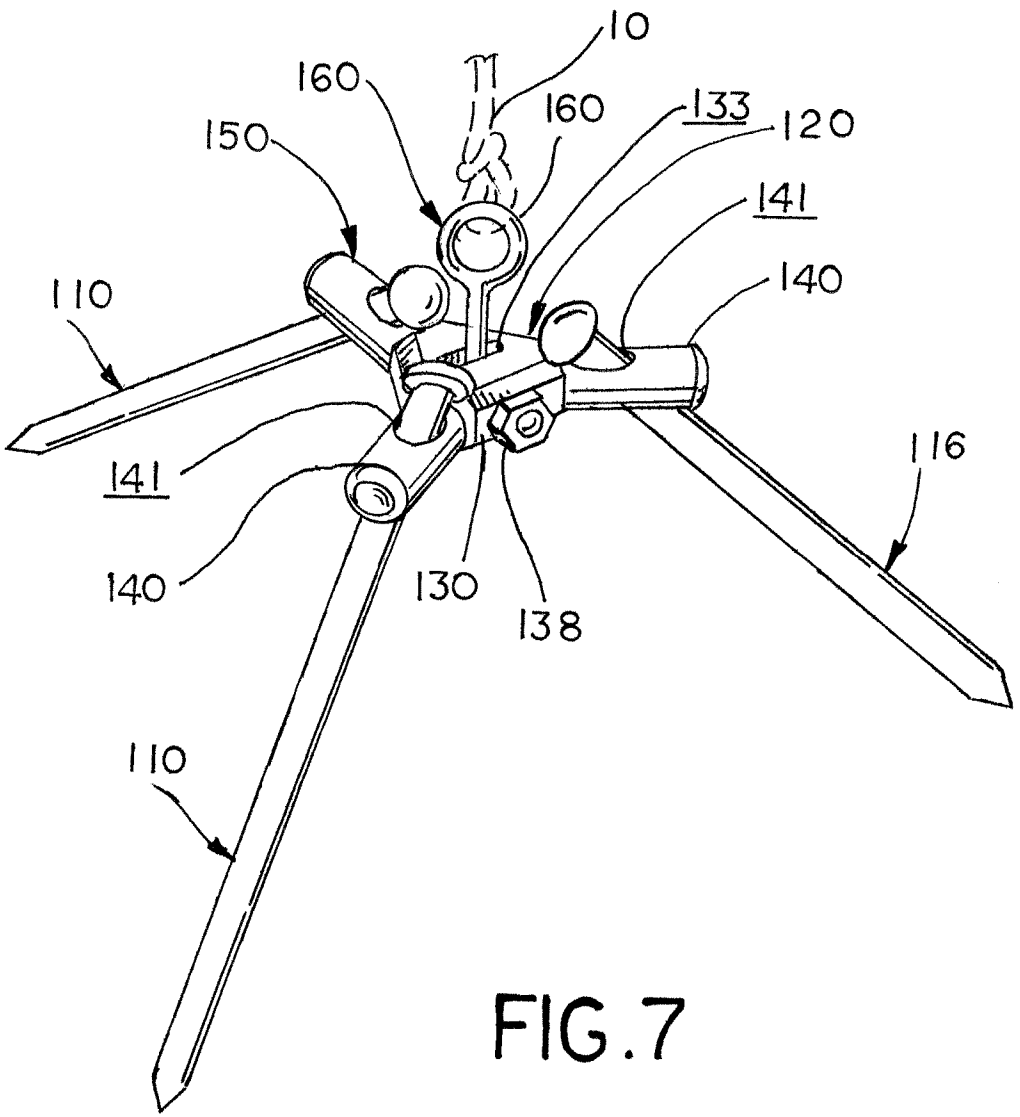
FIG. 7 is another perspective view of the shaft component of the anchor assembly of FIG. 1 shown in the "vertical pull" orientation.
Figure 11:
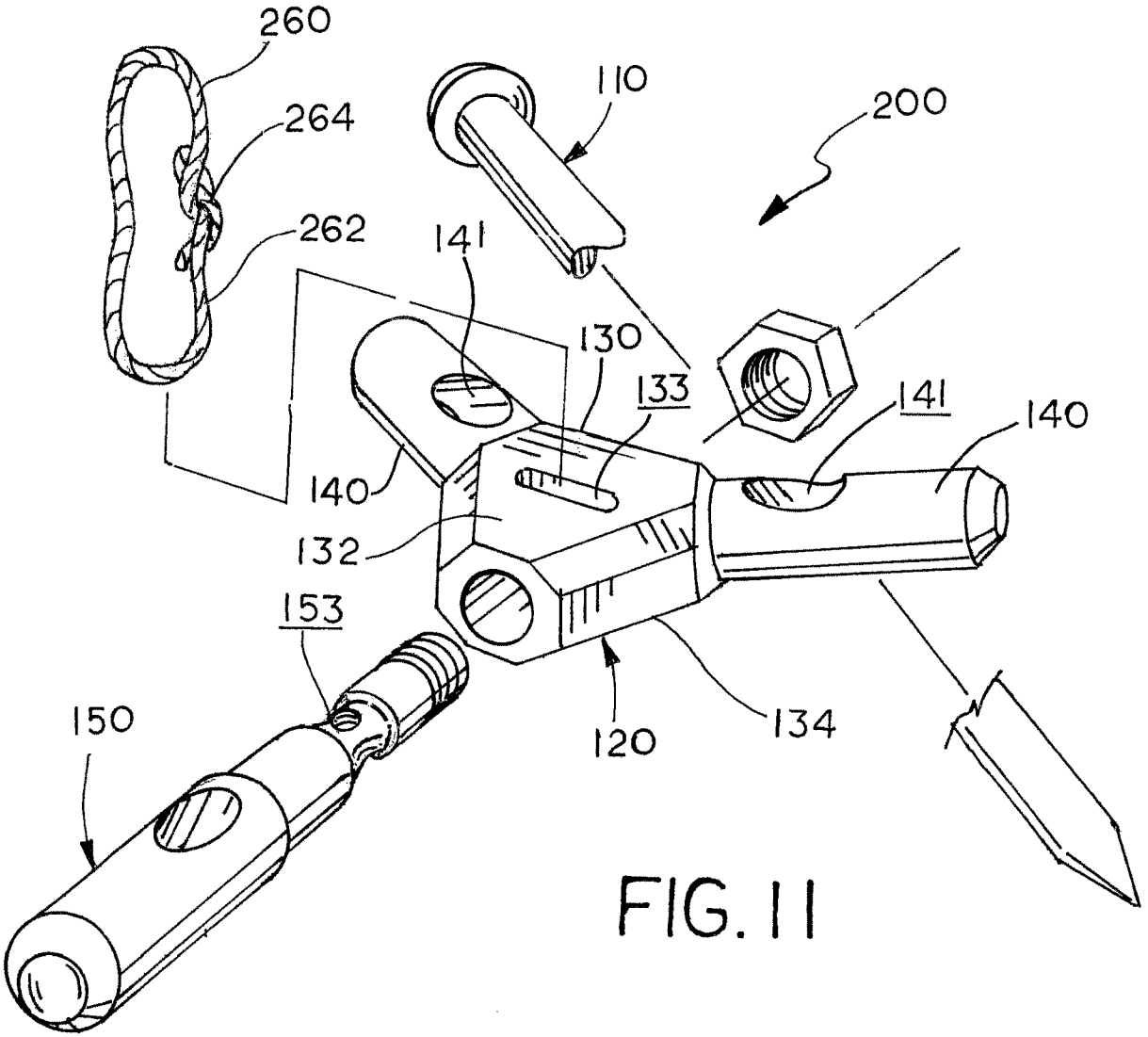
FIG. 11 is an exploded view of a second embodiment of the tie down anchor assembly of this invention.
Figure 12:
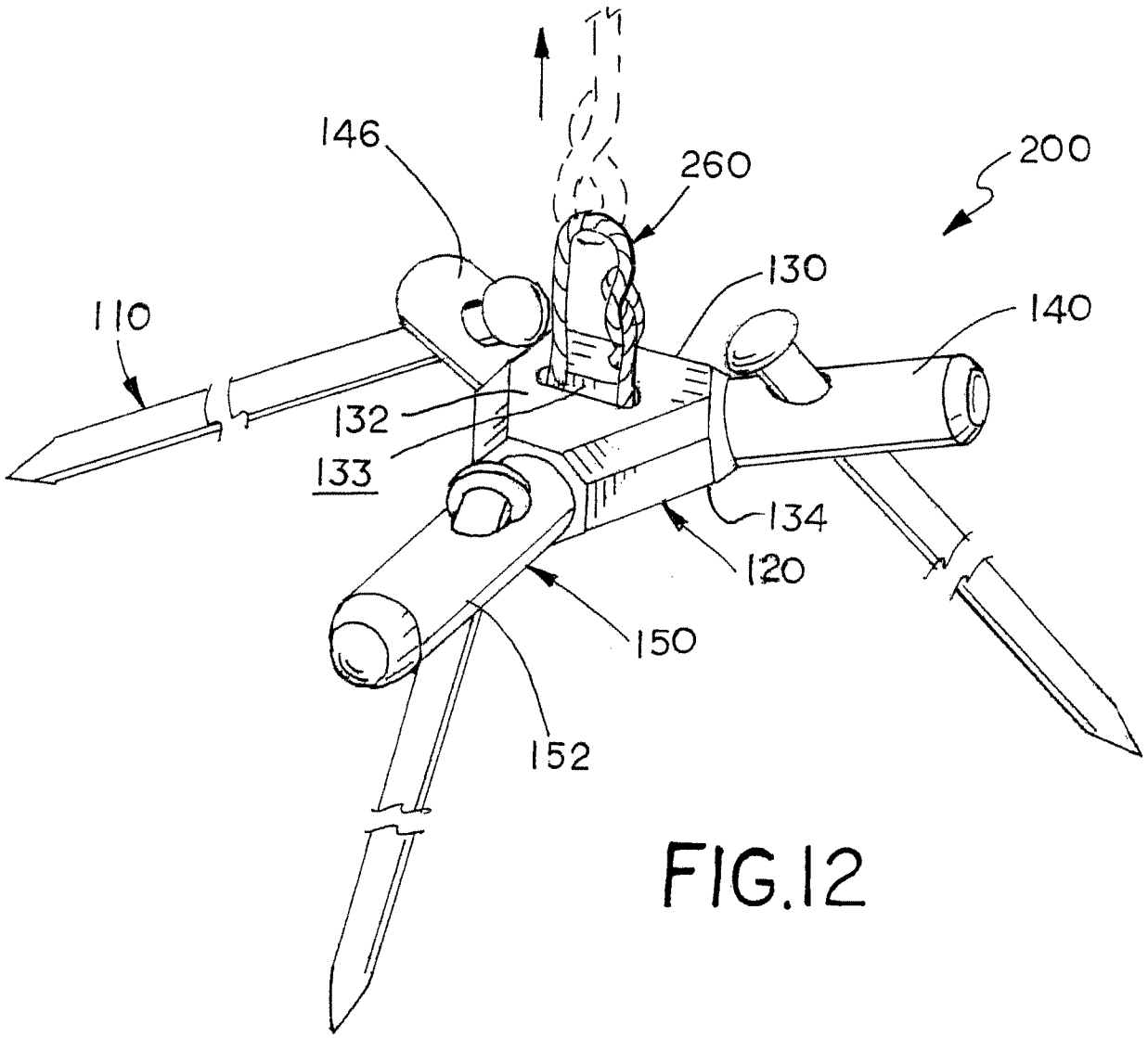
FIG. 12 is a perspective view of the anchor assembly of FIG. 11.

FIGS. 11-12 illustrate a second embodiment of the tie down anchor assembly of this invention, which is designated generally as reference numeral 200. Anchor assembly 200 is identical in form and function as anchor assembly 100 described above, except that the tether connector 260 takes the form of a length of cord. As shown, tether connector 260 is a length of a strong braided nylon cord, such as 550 paracord, but cords and straps or other materials may be used in alternative embodiments. The ends of the cord are tied together to form a loop using a suitable knot to prevent the looped cord from coming untied. Tether connector 260 is seated within slot 133 and shaft component 150 passes through the loop of the tether connector inside main hub component 130. As best shown in FIG. 5, the cord of tether connector 260 extends around shaft component 150 seated in the open area formed by slot 133 of main hub component 130 and annular recess 153 of the shaft component. When disposed within main hub component 130 and receiving shaft component 150, the looped cord of tether connector 260 cannot be pulled from anchor hub 120.

Figure 13:
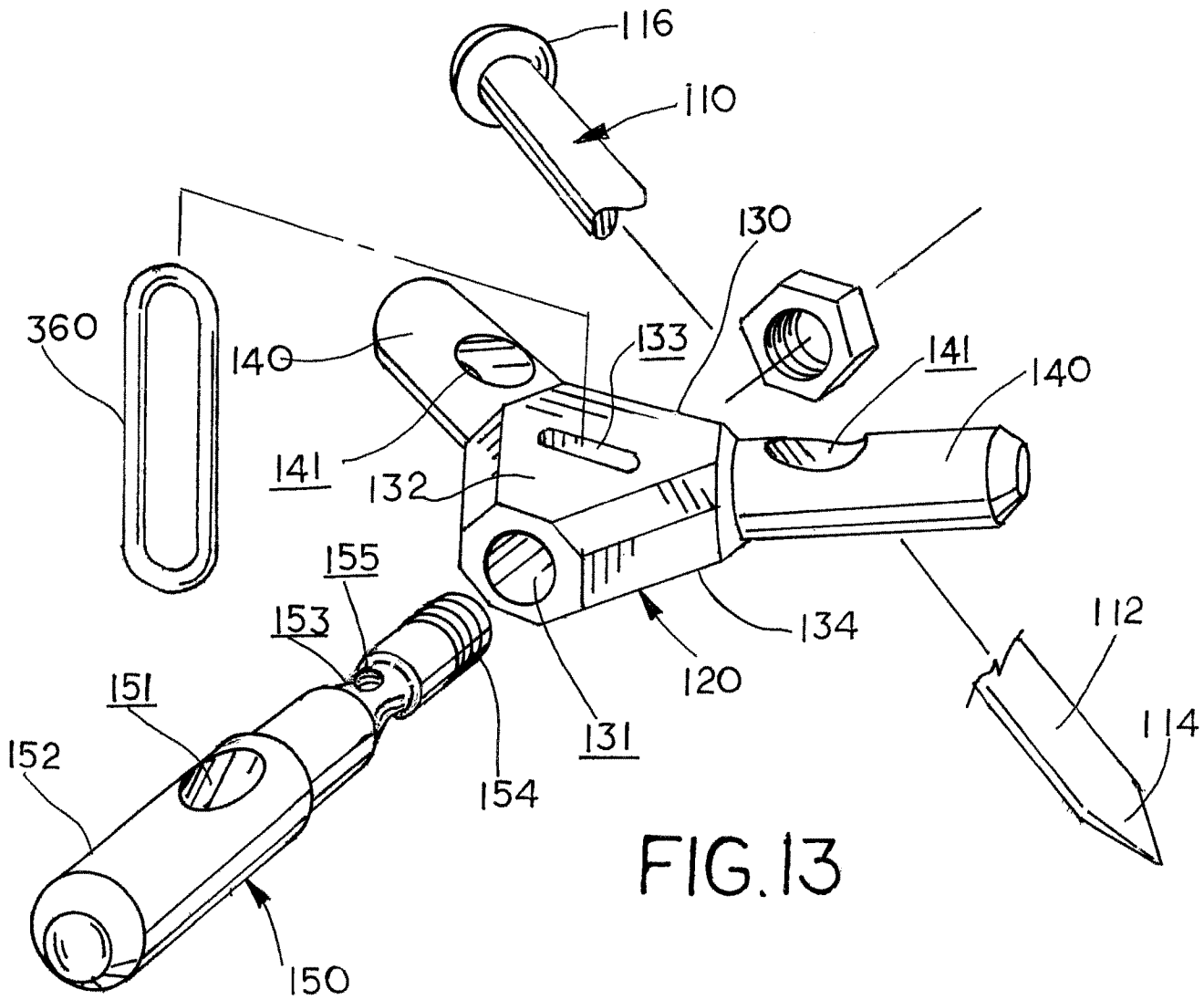
FIG. 13 is an exploded view of a third embodiment of the tie down anchor assembly of this invention.
Figure 14:
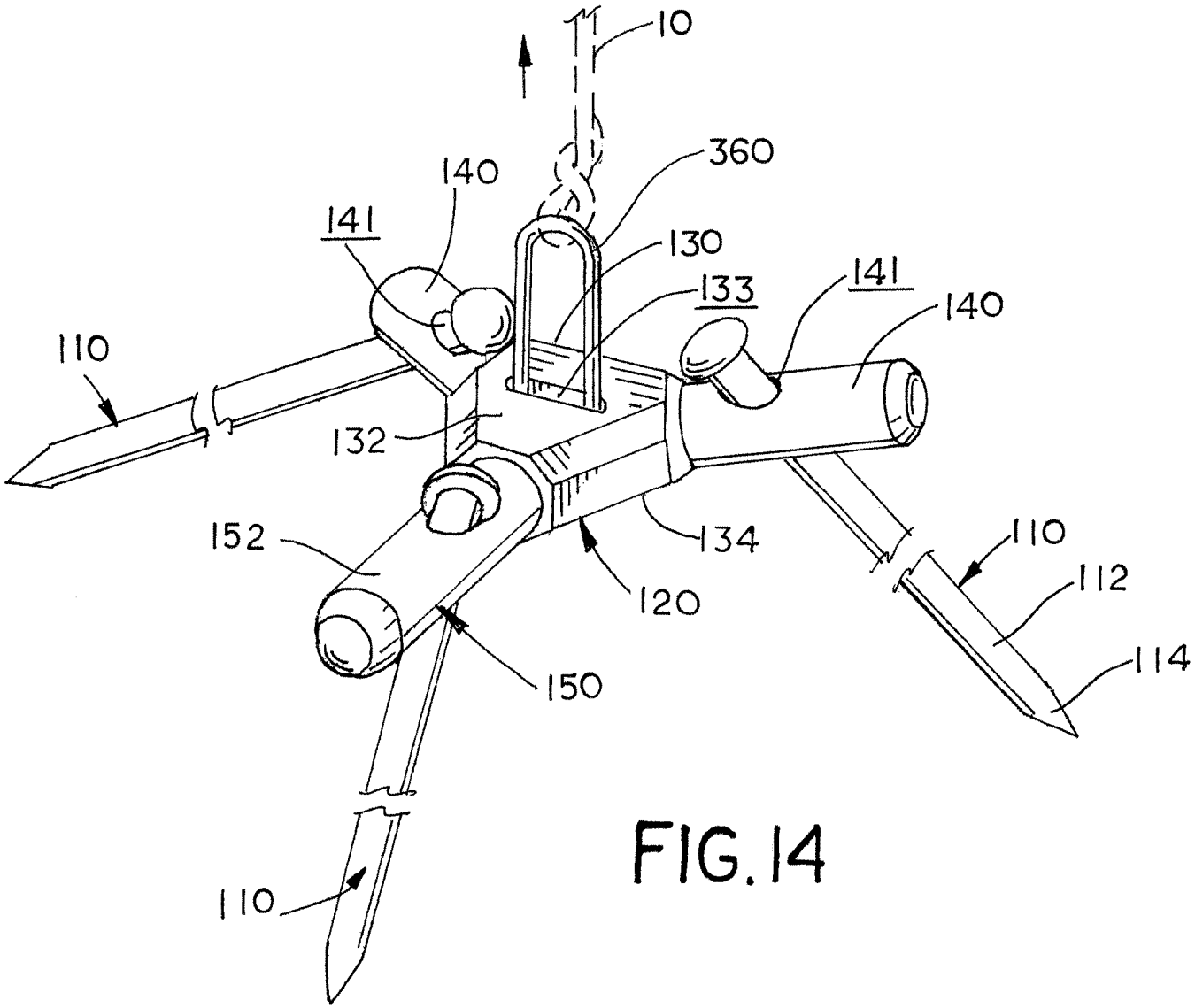
FIG. 14 is a perspective view of the anchor assembly of FIG. 13.

FIGS. 13-14 illustrate a third embodiment of the tie down anchor assembly of this invention, which is designated generally as reference numeral 300. Anchor assembly 300 is identical in form and function as anchor 200 described above, except that the looped cord that form tether connector 260 is replaced by a solid oblong ring. The ring of tether connector 360 is generally made of a suitable metal, such as steel or aluminum, but may be made of a suitable polymer material. Tether connector 360 is dimensioned to sit within slot 133 and receive shaft component 150 inside main hub component 130.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A tie down anchor assembly comprising:

a plurality of elongated stakes;

a hub component; and a connector part detachably affixed to the hub component for affixing a tether line to the hub component, the hub component includes a plurality of elongated protrusions extending radially therefrom, each of the plurality of protrusions having an angled bore for receiving one of the plurality of elongated stakes, one of the plurality of protrusion is rotatably connected to the hub component for rotational movement about its longitudinal axis between a first selected orientation where the angle bore of each of the plurality of protrusions are symmetrically aligned and a second selected position where the angle bore of the one of the plurality of protrusions is not symmetrically aligned with the angle bore of each of the others of the plurality of the protrusions.

2. The anchor assembly of claim 1 wherein the hub component has a top surface and a ground-contacting bottom surface, the hub component also has a shaft bore extending laterally there through parallel to the top surface and the bottom surface.

3. The anchor assembly of claim 2 wherein the one of the plurality of protrusions is an elongated shaft rotatably disposed within the shaft bore of the hub component.

4. The anchor assembly of claim 1 wherein the connector part is a closed loop bolt.

5. The anchor assembly of claim 1 wherein the connector part is a length of cord tied in a loop and adapted to be tied to the anchor hub.

6. The anchor assembly of claim 1 wherein the connector part is a ring part adapted to be affixed to the anchor hub.

7. The anchor assembly of claim 1 wherein the hub component has a top surface and a ground-contacting bottom surface, the hub component also has a shaft bore extending laterally there through parallel to the top surface and the bottom surface, the one of the plurality of protrusions is an elongated shaft rotatably disposed within the shaft bore of the hub component.

8. The anchor assembly of claim 7 wherein the connector part is adapted to affix to the one of the plurality of protrusion to secure the one of the plurality of protrusions in either the first selected orientation or the second selected orientation.

9. The anchor assembly of claim 8 wherein the hub component also has an opening formed in the top surface and extending into the shaft bore.

10. The anchor assembly of claim 7 wherein the connector part is a closed loop bolt.

11. The anchor assembly of claim 10 wherein the shaft of the one of the plurality of protrusion has a threaded bore, the connector part has a threaded shaft adapted to extend through the opening in the hub component and turn into the threaded bore of the shaft of the one of the plurality of protrusions.

12. The anchor assembly of claim 7 wherein the connector part is a length of cord tied in a loop and adapted to be disposed within the opening in the hub component and receive the one of the plurality of protrusions through the loop.

13. The anchor assembly of claim 7 wherein the connector part is a ring part adapted to seat within the opening in the hub component and receive the one of the plurality of protrusions through the loop.

14. The anchor assembly of claim 1 wherein each of the plurality of stakes having a first end and a second end, said first end being sharpened to penetrate the ground and said second end being blunt to receive the blows of a hammer, the second end having a head part by which to grip said stakes.

15. A tie down anchor assembly comprising:

a plurality of elongate stakes;

a hub component having a top surface and a ground-contacting bottom surface, the hub component also having a shaft bore extending laterally there through parallel to the top surface and the bottom surface and an opening formed in the top surface and extending into the shaft bore, the hub component includes a plurality of elongated protrusions extending radially therefrom, each of the plurality of protrusions having an angled bore for receiving one of the plurality of elongated stakes, one of the plurality of protrusions is rotatably connected to the hub component for rotational movement about its longitudinal axis between a first selected orientation where the angle bore of each of the plurality of protrusions are symmetrically aligned and a second selected position where the angle bore of the one of the plurality of protrusions is not symmetrically aligned with the angle bore of each of other of the plurality of the protrusions, the one of the plurality of protrusions is an elongated shaft rotatably disposed within the shaft bore of the hub component; and a connector part detachably affixed to the hub component for affixing a tether line to the hub component and to affix to the one of the plurality of protrusions to secure the one of the plurality of protrusions in either the first selected orientation or the second selected orientation.

* * * * *